US006921510B2

(12) United States Patent
Ott et al.

(10) Patent No.: US 6,921,510 B2
(45) Date of Patent: Jul. 26, 2005

(54) METHOD FOR PREPARING AN ARTICLE HAVING A DISPERSOID DISTRIBUTED IN A METALLIC MATRIX

(75) Inventors: Eric Allen Ott, Cincinnati, OH (US); Andrew Philip Woodfield, Cincinnati, OH (US); Clifford Earl Shamblen, Cincinnati, OH (US); Michael Francis Xavier Gigliotti, Glenville, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/350,968

(22) Filed: Jan. 22, 2003

(65) Prior Publication Data

US 2004/0141869 A1 Jul. 22, 2004

(51) Int. Cl.[7] ..... B22F 3/00

(52) U.S. Cl. ..... 419/10; 419/26; 419/29; 419/41; 419/48; 419/49

(58) Field of Search ..... 419/10, 26, 29, 419/41, 48, 49

(56) References Cited

U.S. PATENT DOCUMENTS

| | | | | | |
|---|---|---|---|---|---|
| 3,501,287 | A | * | 3/1970 | Lever | 419/19 |
| 4,101,713 | A | | 7/1978 | Hirsch | 428/554 |
| 4,512,826 | A | | 4/1985 | Whang | 148/407 |
| 4,519,839 | A | * | 5/1985 | Toyoaki et al. | 75/242 |
| 4,622,079 | A | | 11/1986 | Chang et al. | 148/11.5 |
| 4,906,436 | A | | 3/1990 | Gigliotti, Jr. et al. | 420/418 |
| 4,915,905 | A | | 4/1990 | Kampe et al. | 420/418 |
| 5,041,262 | A | | 8/1991 | Gigliotti, Jr. | 420/419 |
| 5,322,666 | A | | 6/1994 | Watwe | |
| 5,431,874 | A | | 7/1995 | Gigliotti, Jr. | 420/418 |
| 5,779,761 | A | | 7/1998 | Armstrong et al. | |
| 5,930,580 | A | | 7/1999 | Everett | |
| 5,958,106 | A | | 9/1999 | Armstrong et al. | |
| 6,019,812 | A | | 2/2000 | Volas et al. | 75/10.19 |
| 6,251,159 | B1 | | 6/2001 | Angeliu et al. | 75/414 |
| 6,264,719 | B1 | * | 7/2001 | Zhang et al. | 75/252 |
| 6,376,103 | B1 | | 4/2002 | Sampath et al. | 428/633 |
| 6,409,794 | B2 | * | 6/2002 | Wolmer et al. | 75/232 |
| 6,485,584 | B1 | | 11/2002 | Lambard et al. | 148/514 |
| 6,582,651 | B1 | * | 6/2003 | Cochran et al. | 419/5 |

FOREIGN PATENT DOCUMENTS

| | | |
|---|---|---|
| WO | WO 99/64638 | 12/1999 |

* cited by examiner

*Primary Examiner*—Ngoclan T. Mai
(74) *Attorney, Agent, or Firm*—McNees Wallace & Nurick LLC

(57) ABSTRACT

An article has a metallic matrix made of its constituent elements with a dispersoid distributed therein. The article is prepared by furnishing at least one nonmetallic matrix precursor compound. All of the nonmetallic matrix precursor compounds collectively include the constituent elements of the metallic matrix in their respective constituent-element proportions. A mixture of an initial metallic material and the dispersoid is produced. The matrix precursor compounds are chemically reduced to produce the initial metallic material, without melting the initial metallic material, and the dispersoid is distributed in the initial metallic material. The mixture of the initial metallic material and the dispersoid is consolidated to produce a consolidated article having the dispersoid distributed in the metallic matrix comprising the initial metallic material. The initial metallic material, the dispersoid, and the consolidated article are not melted during the consolidation.

29 Claims, 3 Drawing Sheets

METHOD FOR PREPARING AN ARTICLE HAVING A DISPERSOID DISTRIBUTED IN A METALLIC MATRIX

This invention relates to the preparation of a material in which a dispersoid is dispersed through a metallic matrix, and more particularly to the preparation of such a material that avoids any melting of the constituents.

BACKGROUND OF THE INVENTION

Materials having a dispersion of substantially inert dispersoids distributed in a metallic matrix are known. An example is TD-nickel, in which thorium oxide dispersoid is distributed through a nickel matrix. The dispersoids improve the mechanical properties of the material by interfering with dislocation movement, particularly if the dispersoids are closely spaced, and also by inhibiting the movement of the grain boundaries of the matrix during elevated temperature exposure.

There are two primary techniques for producing such materials, mechanical alloying and spray forming. In mechanical alloying, the more widely used of the two approaches, the material of the metallic matrix is melted and solidified as a powder. One or more types of metallic powders are mixed with the dispersoid, and the mixture is mechanically deformed in a high-energy environment such as a ball mill. In the mechanical deformation, the largely nondeformable dispersoid is incorporated into the deformable metallic powder(s) by repeated fracturing and cold welding of the metallic powder particles with the dispersion contained at the welded interfaces. After the mechanical deformation, the mixture is consolidated. This approach requires lengthy and/or costly ball milling operations which can be prone to the introduction of defects into the mechanically alloyed material. Additionally, many metallic matrix materials that are otherwise of interest cannot be used in mechanical alloying, because they are not sufficiently malleable to cold weld to the dispersoids in the ball milling. The use of mechanical alloying is therefore limited primarily to lower-strength, higher-ductility metallic materials.

In spray forming, metallic material is melted and sprayed from a spray gun to solidify or partially solidify in a suitable inert atmosphere prior to being consolidated against a substrate. The dispersoid is added to the spray of the metallic material as it leaves the spray gun and is thereby mixed with the solidified metal. Spray forming can only be used in specialized circumstances, inasmuch as the process is limited to the use of dispersoids that do not react with or melt in the molten metal, the process is expensive, and it is difficult to control the size and spacing of the dispersoid. The microstructure is dominated by the solidification structure of the metallic material produced at rapid cooling rates.

There is a need for an improved approach to the preparation of articles having a metallic matrix with dispersoids distributed therein. The required improvements include reducing the manufacturing time, reducing the number of process steps, reducing the sources of contamination, and permitting the use of higher strength matrix materials in combination with fine dispersoids. The present invention fulfills this need, and further provides related advantages.

SUMMARY OF THE INVENTION

The present invention provides a technique for preparing an article having a metallic alloy matrix with a fine dispersoid distributed therein. The article is preferably prepared without melting of the metal alloy and without mechanical deformation of the metal alloy, prior to final consolidation and mechanical forming. The incidence of defects in the metallic matrix is thereby greatly reduced, as compared with mechanical alloying. The present approach allows the use of higher-strength metallic matrix materials than possible with mechanical alloying, and the use of different dispersoids than are possible with prior approaches. There is less anisotropy in the final article, and a fine grain structure can be achieved in the final article. The cost of manufacturing the article by the present approach is less than with prior approaches.

An article has a metallic matrix made of its constituent elements with a dispersoid distributed therein. The article is prepared by furnishing at least one nonmetallic matrix precursor compound. All of the nonmetallic matrix precursor compounds collectively include the constituent elements of the metallic matrix in their respective constituent-element proportions. A mixture of an initial metallic material and the dispersoid is produced. The matrix precursor compounds are chemically reduced to produce the initial metallic material, without melting the initial metallic material, and the dispersoid is distributed in the initial metallic material. The mixture of the initial metallic material and the dispersoid is consolidated to produce a consolidated article having the dispersoid distributed in the metallic matrix comprising the initial metallic material. The initial metallic material, the dispersoid, and the consolidated article are not melted during the consolidation. Preferably, there is no mechanical deformation of the initial metallic material prior to the step of consolidating.

The initial metallic material and the matrix of the final article may be of any operable constituents. The present approach is operable, for example, with nickel-base, iron-base, cobalt-base, titanium-base, magnesium-base, and aluminum-base materials.

The dispersoids may be introduced into and mixed with the metallic component in any operable manner. In one preferred approach, the step of producing includes the steps of furnishing the dispersoids, and mixing the dispersoids with the matrix precursor compounds prior to or concurrently with the step of chemically reducing. In another preferred approach, the step of producing includes the steps of furnishing the dispersoids, and mixing the dispersoids with the initial metallic material after the step of chemically reducing. In another preferred approach, the step of producing includes the steps of furnishing a dispersoid-precursor, and mixing the dispersoid precursor with the matrix precursor compound prior to or concurrently with the step of chemically reducing, and wherein the dispersoid precursor chemically reacts during the step of chemically reacting to produce the dispersoid. In another preferred approach, an element of the dispersoid may be supplied as a precursor compound to be reduced in a second reduction step and then reacted to form the desired dispersoid compound.

The matrix precursor compounds may be furnished in any operable physical form. For example, a compressed mass of the matrix precursor compounds may be furnished. Typically, such a compressed mass is larger in dimensions than the consolidated article. The matrix precursor compounds may instead be furnished in an uncompressed, free-flowing form of finely divided particles, or a liquid, or a vapor.

The chemical reduction may be performed by any operable approach, such as solid-phase reduction or vapor-phase reduction. The chemical reduction may produce the initial metallic material in any operable form. For example, the step of chemically reducing may produce a sponge of the initial metallic material, or particles of the initial metallic material.

The consolidation may be performed by any operable approach, such as, for example, hot isostatic pressing, forging, pressing and sintering, and containerized extrusion. After consolidation, the consolidated article may be formed, heat treated, or otherwise final processed.

The present approach produces an article that has a metallic matrix and dispersoids uniformly distributed in the bulk of the metallic matrix, or with a high concentration near the surface if desired. A wide variety of metallic materials and dispersoid materials may be used. The dispersoids may be, for example, oxides, carbides, nitrides, borides, or sulfides, or combinations of the constituent elements, such as carbonitrides, formed with the elements of the metallic matrix or with other intentionally added elements. The dispersoids are selected to be either thermodynamically stable (non-reducible) compared to the matrix alloy, or too chemically inert and stable to be reduced by the process that reduces the matrix precursor compounds. The dispersoid is introduced at a point in the processing where it is stable with respect to all subsequent processing steps. The metallic matrix is never melted during the preparation processing, so that there is little if any chemical reaction between the metallic components and the dispersoid. In the preferred approach, there is no high-energy or other deformation of the metallic material prior to consolidation, so that there is a greatly reduced incidence of the mechanical and heating defects that are associated with mechanical alloying. Additionally, because the introduction of the dispersoid does not depend upon the mechanical deformation of the matrix material, the present approach may be used with a broader range of useful metallic alloy systems than possible with mechanical alloying. High-strength alloys that are not amenable to extensive mechanical deformation may be produced with a distribution of the dispersoid therein by the present approach but not by mechanical alloying. New types of dispersoids may also be used. Those dispersoids may be added as the dispersoid compound, or in some cases may be added as elements or precursor compounds that react with the matrix alloy to form the dispersoids. Alternatively, the precursor compound may react with other components in a separate reaction step.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
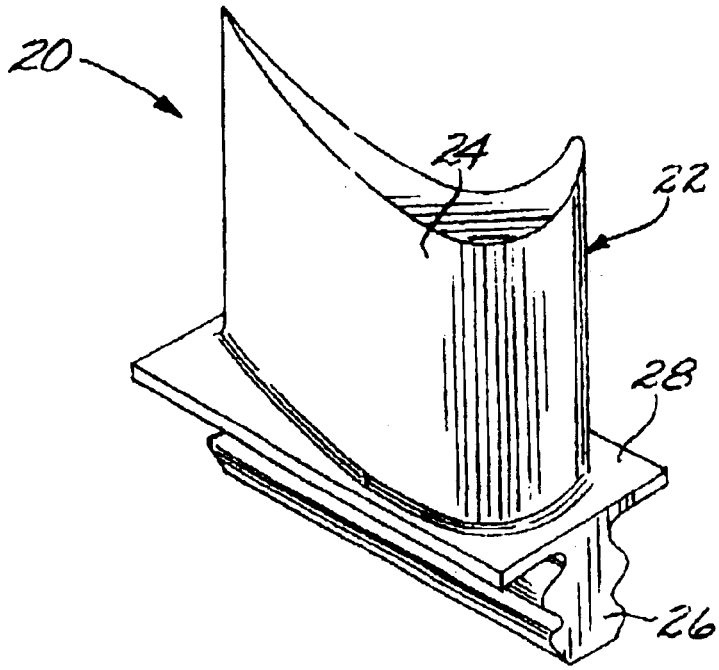
FIG. 1 is a perspective view of an article made by the present approach.

FIG. 1 depicts a component article 20 of a gas turbine engine such as a compressor blade 22. The compressor blade 22 is preferably formed of a titanium-base alloy having a dispersoid therein, as will be discussed in greater detail. The compressor blade 22 includes an airfoil 24 that acts against the incoming flow of air into the gas turbine engine and axially compresses the air flow. The compressor blade 22 is mounted to a compressor disk (not shown) by a dovetail 26 which extends downwardly from the airfoil 24 and engages a slot on the compressor disk. A platform 28 extends longitudinally outwardly from the area where the airfoil 24 is joined to the dovetail 26.

A titanium-base alloy having a dispersoid therein is one preferred application of the present approach, and it will be used to illustrate specific embodiments. However, the present approach is not limited to titanium-based alloys with dispersoids therein, and is applicable to other types of metallic alloys with dispersoids therein.

Figure 2:
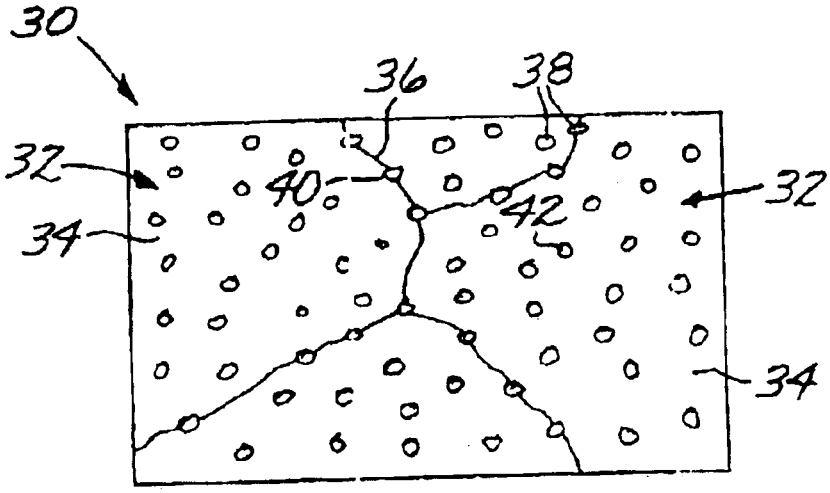
FIG. 2 is an idealized microstructure of the article of FIG. 1.

FIG. 2 is an idealized depiction of the microstructure 30 of the article 20. The microstructure 30 includes grains 32 of a metallic matrix 34 with grain boundaries 36 separating the grains 32. The metallic matrix comprises its alloy constituent elements. A dispersoid 38 in the form of a plurality of dispersoid particles is distributed in the metallic matrix 34. The dispersoid 38 may include grain-boundary dispersoid particles 40 that reside along the grain boundaries 36, and interior dispersoid particles 42 that reside within the grains 32. The grain-boundary dispersoid particles 40 serve to limit grain growth during elevated-temperature exposure, and the interior dispersoid particles 42 serve to restrict dislocation movement to increase the alloy's strength, most specifically the creep resistance. Examples of suitable dispersoids include, for example, oxides, carbides, nitrides, borides, or sulfides, formed with the elements of the metallic matrix or with other intentionally added elements. The dispersoids may be simple chemical forms. The dispersoids may instead be more complex, multicomponent compounds such as, for example, carbonitrides or multicomponent oxides such as $Y_2O_3$—$Al_2O_3$-based oxides. Such dispersoids include an element (or elements) selected from the group consisting of oxygen, carbon, nitrogen, boron, sulfur, and combinations thereof. The dispersoids are either thermodynamically stable (non-reducible) compared to the matrix alloy, or too chemically inert to be reduced by the process that reduces the matrix precursor compounds. The dispersoid is introduced at a point in the processing where it is stable with respect to all subsequent processing steps. That is, if a particular type of dispersoid is unstable with respect to some earlier processing step, it is introduced only after that processing step is completed.

The dispersoid 38 (including both grain-boundary dispersoid particles 40 and interior dispersoid particles 42) may be present in any amount. However, the dispersoid 38 is preferably present in an amount sufficient to provide increased strength to the article 20 by inhibiting dislocation movement in the metallic matrix 34, by acting as a composite-material strengthener, and/or by inhibiting movement of the grain boundaries 36. The volume fraction of dispersoid 38 required to perform these functions varies depending upon the nature of the matrix 34 and the dispersoid 38, but is typically at least about 0.5 percent by volume of the article, and more preferably at least about 1.5 percent by volume of the article. To achieve these volume fractions, the elements that react to form the dispersoid 38 must be present in a sufficient amount.

Figure 3:
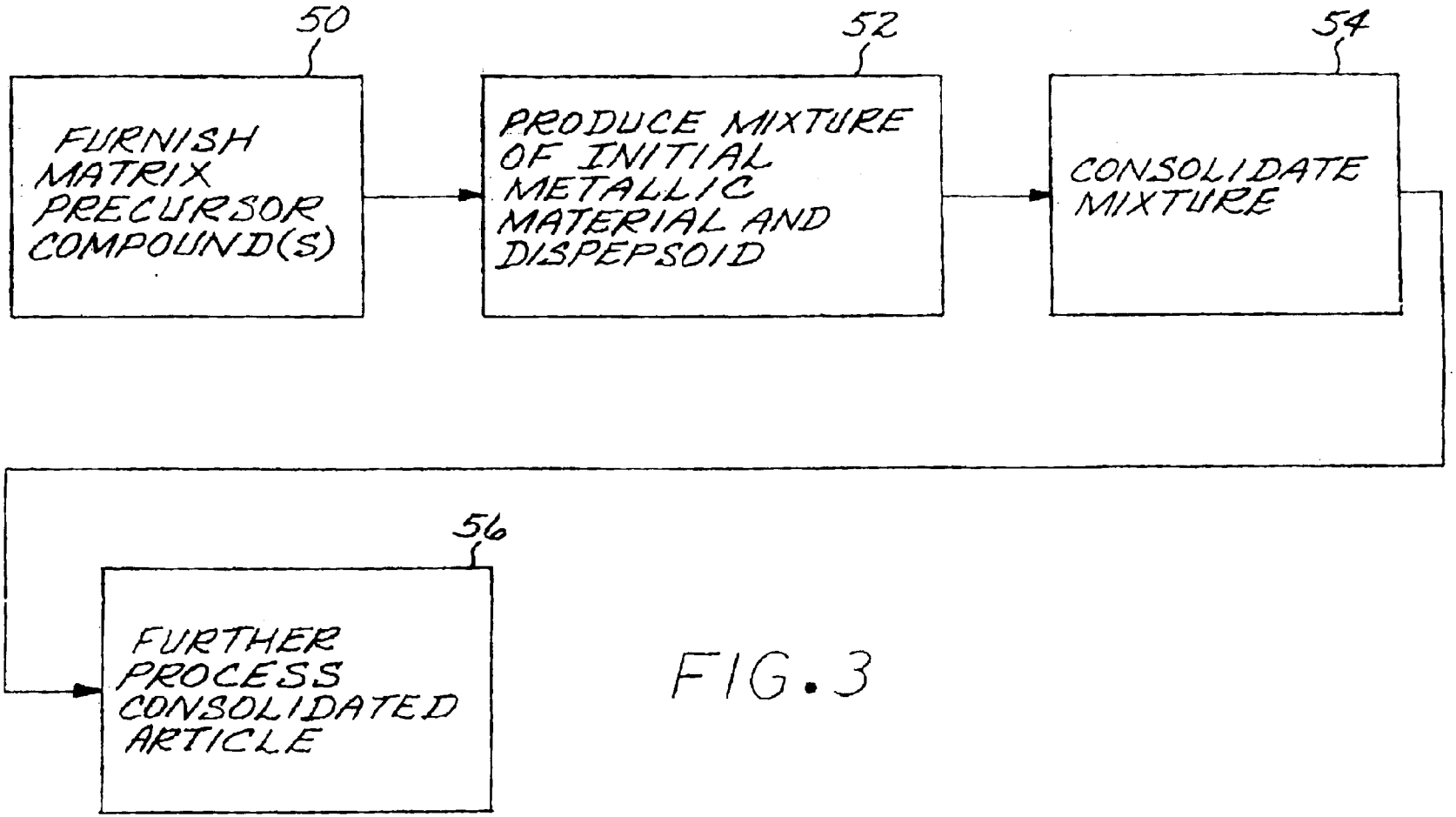
FIG. 3 is a block flow diagram of a preferred approach for practicing the invention.

FIG. 3 is a block flow diagram illustrating a preferred method for producing the article 20. At least one nonmetallic matrix precursor compound is furnished, step 50. As used herein, the term "metallic alloy" includes both conventional metallic alloys and intermetallic compounds formed of metallic constituents, such as approximately equiatomic TiAl. Relatively small amounts of nonmetallic elements, such as boron, carbon, and silicon, may also be present. All of the nonmetallic matrix precursor compounds collectively include the constituent elements of the metallic matrix in their respective constituent-element proportions. (The dispersoid or its precursor is supplied separately, as will be discussed.) The metallic elements may be supplied by the matrix precursor compounds in any operable way. In the preferred approach, there is exactly one precursor compound for each alloying element, and that one precursor compound provides all of the material for that respective metallic constituent in the alloy. For example, for a four-element metallic matrix material that is the final result of the process, a first precursor compound supplies all of the first element, a second precursor compound supplies all of the second element, a third precursor compound supplies all of the third element, and a fourth precursor compound supplies all of the fourth element. Alternatives are within the scope of the approach, however. For example, several of the precursor compounds may together supply all of one particular metallic element. In another alternative, one precursor compound may supply all or part of two or more of the metallic elements. The latter approaches are less preferred, because they make more difficult the precise determination of the elemental proportions in the final metallic material.

The metallic matrix 34 and its constituent elements comprise any operable type of alloy. Examples include a nickel-base material, an iron-base material, a cobalt-base material, a titanium-base material, a magnesium-base material, and an aluminum-base material. An "X-base" alloy has more of element X than any other element.

The matrix precursor compounds are nonmetallic and are selected to be operable in the reduction process in which they are reduced to metallic form. In one reduction process of interest, solid-phase reduction, the precursor compounds are preferably metal oxides. In another reduction process of interest, vapor-phase reduction, the precursor compounds are preferably metal halides. Mixtures of different types of matrix precursor compounds may be used, as long as they are operable in the subsequent chemical reduction.

The nonmetallic precursor compounds are selected to provide the necessary alloying elements in the final metallic article, and are mixed together in the proper proportions to yield the necessary proportions of these alloying elements in the metallic article. For example, if the final article were to have particular proportions of titanium, aluminum, vanadium, erbium, and oxygen in the ratio of 86.5:6:4:3:0.5 by weight, the nonmetallic precursor compounds are preferably titanium oxide, aluminum oxide, vanadium oxide, and erbium oxide for solid-phase reduction. The final oxygen content is controlled by the reduction process as discussed subsequently. Nonmetallic precursor compounds that serve as a source of more than one of the metals in the final metallic article may also be used. These precursor compounds are furnished and mixed together in the correct proportions such that the ratio of titanium:aluminum:vanadium:erbium in the mixture of precursor compounds is that required to form the metallic alloy in the final article.

A mixture of an initial metallic material and the dispersoid is produced, step 52. As part of the producing step 52, the single nonmetallic precursor compound or the mixture of nonmetallic precursor compounds is chemically reduced to produce the initial metallic material, without melting the initial metallic particles. As used herein, "without melting", "no melting", and related concepts mean that the material is not macroscopically or grossly melted for an extended period of time, so that it liquefies and loses its shape. There may be, for example, some minor amount of localized melting as low-melting-point elements melt and are diffusionally alloyed with the higher-melting-point elements that do not melt, or very brief melting for less than about 10 seconds. Even in such cases, the gross shape of the material remains unchanged.

In one preferred reduction approach, termed vapor-phase reduction because the nonmetallic precursor compounds are furnished as vapors or gaseous phase, the chemical reduction may be performed by reducing mixtures of halides of the base metal and the alloying elements using a liquid alkali metal or a liquid alkaline earth metal. For example, titanium tetrachloride and the halides of the alloying elements are provided as gases. A mixture of these gases in appropriate amounts is contacted to molten sodium, so that the metallic halides are reduced to the metallic form. The metallic alloy is separated from the sodium. This reduction is performed at temperatures below the melting point of the metallic alloy. The approach is described more fully in U.S. Pat. Nos. 5,779,761 and 5,958,106, whose disclosures are incorporated by reference.

Reduction at lower temperatures rather than higher temperatures is preferred. Desirably, the reduction is performed at temperatures of 600° C. or lower, and preferably 500° C. or lower. By comparison, prior approaches for preparing specific metallic alloys often reach temperatures of 900° C. or greater. The lower-temperature reduction is more controllable, and also is less subject to the introduction of contamination into the metallic alloy, which contamination in turn may lead to chemical defects Additionally, the lower temperatures reduce the incidence of sintering together of the particles during the reduction step.

In this vapor-phase reduction approach, a nonmetallic modifying element or compound presented in a gaseous form may be mixed into the gaseous nonmetallic precursor compound prior to its reaction with the liquid alkali metal or the liquid alkaline earth metal. In one example, oxygen or nitrogen may be mixed with the gaseous nonmetallic matrix precursor compound(s) to increase the level of oxygen or nitrogen, respectively, in the initial metallic material. It is sometimes desirable, for example in a titanium-base alloy, that the oxygen content of the initial metallic particle and the final metallic article be about 1200–2000 parts per million by weight to strengthen the final metallic article or to provide oxygen that is used in forming the dispersoid. Rather than adding the oxygen in the form of solid titanium dioxide powder, as is sometimes practiced for titanium-base alloys produced by conventional melting techniques, the oxygen is added in a gaseous form that facilitates mixing and minimizes the likelihood of the formation of hard alpha phase in the final article. When the oxygen is added in the form of titanium dioxide powder in conventional melting practice, agglomerations of the powder may not dissolve fully, leaving fine particles in the final metallic article that constitute chemical defects. The present approach avoids that possibility. For other alloy systems, lower oxygen, nitrogen, etc. content may also be beneficial. Similarly, elements such as sulfur and carbon may be added using appropriate gaseous compounds of these elements. Complex combinations of such gaseous elements may be provided and mixed together, such as gaseous compounds of oxygen, nitrogen, sulfur, and/or carbon, leading to the formation of chemically more-complex dispersoids.

In another reduction approach, termed solid-phase reduction because the nonmetallic matrix precursor compounds are furnished as solids, the chemical reduction may be performed by fused salt electrolysis. Fused salt electrolysis is a known technique that is described, for example, in published patent application WO 99/64638, whose disclosure is incorporated by reference in its entirety. Briefly, in fused salt electrolysis the mixture of nonmetallic matrix precursor compounds, furnished in a finely divided solid form, is immersed in an electrolysis cell in a fused salt electrolyte such as a chloride salt at a temperature below the melting temperature of the alloy that forms from the nonmetallic matrix precursor compounds. The mixture of nonmetallic matrix precursor compounds is made the cathode of the electrolysis cell, with an inert anode. The elements combined with the metals in the nonmetallic matrix precursor compounds, such as oxygen in the preferred case of oxide nonmetallic matrix precursor compounds, are partially or completely removed from the mixture by chemical reduction (i.e., the reverse of chemical oxidation). The reaction is performed at an elevated temperature. The cathodic potential is controlled to ensure that the reduction of the nonmetallic matrix precursor compounds will occur, rather than other possible chemical reactions such as the decomposition of the molten salt. The electrolyte is a salt, preferably a salt that is more stable than the equivalent salt of the metals being refined and ideally very stable to remove the oxygen or other gas to a desired low level. The chlorides and mixtures of chlorides of barium, calcium, cesium, lithium, strontium, and yttrium are preferred. The chemical reduction is preferably, but not necessarily, carried to completion, so that the nonmetallic matrix precursor compounds are completely reduced. Not carrying the process to completion is a method to control the oxygen content of the metal produced.

In another reduction approach, termed "rapid plasma quench" reduction, the precursor compound such as titanium chloride is dissociated in a plasma arc at a temperature of over 4500° C. The precursor compound is rapidly heated, dissociated, and quenched in hydrogen gas. The result is fine metallic-hydride particles. Any melting of the metallic particles is very brief, on the order of 10 seconds or less, and is within the scope of "without melting" and the like as used herein. The hydrogen is subsequently removed from the metallic-hydride particles by a vacuum heat treatment. Oxygen or other gas (e.g., nitrogen) may also be added to react with the stable-dispersoid-forming additive elements to form the stable dispersion.

The dispersoid 38 in the form of the dispersoid particles is introduced during the producing step 52. The dispersoid 38 may be of any operable type. The dispersoid 38 be furnished in its final form, or it may be furnished as a precursor that is reacted to produce the final form of the dispersoid. The selection of the dispersoid 38 is made in conjunction with the type of matrix alloy and the requirements of the final article. Some examples of the dispersoids may be oxides, carbides, nitrides, borides, or sulfides, or combinations thereof, such as carbonitrides, formed with the elements of the metallic matrix or with other intentionally added elements.

Four approaches for introducing the dispersoid 38 are of particular interest. In a first approach, the dispersoids are finished in essentially their final form and are mixed with the matrix precursor compounds prior to or concurrently with the step of chemically reducing. That is, the mixture of matrix precursor compounds and dispersoids is given the chemical reduction treatment, but only the matrix precursor compounds are actually reduced. The dispersoids are selected to be either thermodynamically stable (non-reducible) compared to the matrix alloy, or too chemically inert to be reduced by the process that reduces the matrix precursor compounds. The dispersoid is introduced at a point in the processing where it is stable with respect to all subsequent processing steps.

In a second approach, the dispersoids are furnished but not subjected to the chemical reduction treatment. Instead, they are mixed with the initial metallic material that results from the chemical reduction step, but after the step of chemically reducing is complete. This approach is particularly effective when the step of chemically reducing is performed on a flowing powder of the matrix precursor compounds, but it also may be performed on a pre-compacted mass of the matrix precursor compounds, resulting in a spongy mass of the initial metallic material. The dispersoids 38 are received onto the surface of the powder or on the surface of, and into the porosity of, the spongy mass.

In a third approach, a dispersoid-precursor is furnished, rather than the final precursor. The dispersoid precursor is mixed with the matrix precursor compound prior to or concurrently with the step of chemically reducing. The dispersoid precursor chemically reacts with another element or elements during the step of chemically reacting to produce the dispersoid. For example, the dispersoid-precursor could be an oxide former such as magnesium, calcium, scandium, thorium, and yttrium, and rare earths such as lanthanum, cerium, praseodymium, neodymium, promethium, samarium, europium, gadolinium, terbium, dysprosium, holmium, erbium, thulium, ytterbium, and lutetium, and mixtures thereof, which react with excess oxygen during the chemical reduction to produce oxide dispersoids.

In a fourth approach, the matrix precursor is first produced as powder particles, or as a sponge by compacting the precursor compounds of the metallic elements. The particles or sponge is then first chemically reduced. The dispersoid is thereafter produced at the surfaces (external and internal, if the particles are spongelike) of the particles, or at the external and internal surfaces of the sponge. In one approach, the particles or sponge is dipped into a solution of a precursor compound of the dispersoid, such as an erbium chloride solution, to coat the surfaces of the particles or the sponge. The precursor compound of the dispersoid is second chemically reduced to produce the first element of the dispersoid, such as erbium, at the surfaces of the particles or at the surfaces of the sponge. The element of the dispersoid is then chemically reacted (for example, oxidized) to produce the dispersoid, erbium oxide in the example, distributed over the surfaces of the particles or the sponge. Upon the subsequent consolidation, discrete dispersoids are distributed throughout the consolidated and compacted article. In some cases the oxidation may be performed during or integral with the consolidation process. The dispersoid may also be broken into smaller pieces in the consolidation process and distributed further through the metallic matrix.

Whatever the reduction technique used in step 52 and however the dispersoid is introduced, the result is a mixture of an initial metallic material and the dispersoid. The initial metallic material may be free-flowing particles in some circumstances, or have a sponge-like structure in other cases. The sponge-like structure is produced in the solid-phase reduction approach if the matrix precursor compounds have first been compacted together prior the commencement of the actual chemical reduction. The matrix precursor compounds may be compressed to form a compressed mass that is larger in dimensions than a desired final metallic article.

The mixture of the initial metallic material and the dispersoid is thereafter or concurrently consolidated to produce a consolidated article, step 54, without melting the initial metallic material, without melting the dispersoid, and without melting the consolidated article. The consolidation step 54 may be performed by any operable technique, with examples being hot isostatic pressing, forging, pressing and sintering, and containerized extrusion.

It is preferred that there be no mechanical deformation of initial metallic material and/or the mixture of the initial metallic material and the dispersoid, prior to the step of consolidating. Such mechanical deformation is unnecessary with the present approach, unlike the mechanical alloying approach.

Figure 4:
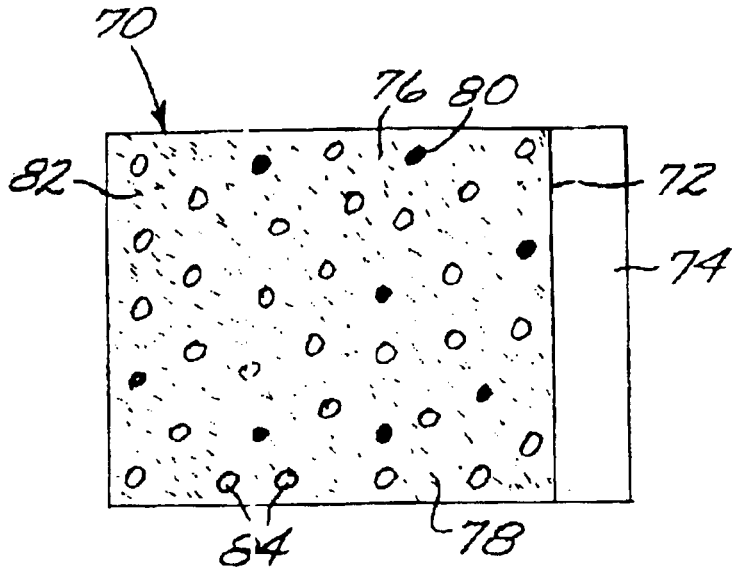
FIG. 4 is an idealized microstructure of the metallic article, after some reaction that produces a uniform dispersion.

FIG. 4 illustrates the microstructure of the metallic article 70 having a surface 72 facing the environment 74. The metallic article 70 has a microstructure of an alloy matrix 76 with unreacted stable-dispersoid-forming additive element (s) and/or the dispersoids dispersed generally uniformly therethrough. The stable-dispersoid-forming additive element(s) may be present in solid solution, numeral 78, or as one or more unreacted discrete phases 80. (If the dispersoids are added in their final form, there will be little or none of the unreacted element in solid solution 78 or the unreacted discrete phases 80.) Some of the stable-dispersoid-forming additive element(s) initially in solid solution may have been furnished as, or reacted with oxygen initially present in the matrix 76 to form, a dispersion of fine stable dispersoids 82. Some of the stable-dispersoid-forming additive element(s) initially present as unreacted discrete phase 80 may have been furnished as, or reacted with oxygen initially present in the matrix 76 to form, a dispersion of coarse stable dispersoids 84. (As used herein, "coarse" and "fine" are used only in a relative sense to each other, with "coarse" dispersoids being larger in size than "fine" dispersoids. Both the coarse stable dispersoids and the fine stable dispersoids provide strengthening effects.) These stable dispersoids 82 and 84 are distributed substantially uniformly throughout the matrix 76.

The primary embodiment of the present approach is therefore directed to the formation of a substantially uniform distribution of dispersoids 38 in the matrix 34. The uniformity is microscopically judged quantitatively at a depth of more than about 0.003 inches from the surface, in a square field of about 0.008 inches on a side. Mean spacings of the particles are measured in this field, and compared with values in other fields at depths of more than about 0.003 inches from the surface, measured separately but in the same manner. Desirably, the mean spacings of the particles are within about 25 percent, more preferably about 10 percent, of each other in the different fields.

Optionally but typically, there is further processing, step 56, of the consolidated article. In this processing, the article is not melted. Such further processing may include, for example, mechanically forming the consolidated article by any operable approach, machining the consolidated article by any operable approach, coating the consolidated article by any operable approach, or heat treating the consolidated article by any operable approach. These steps are selected according to the type of matrix and dispersoid, the shape required, and the application. Such procedures are known generally in the art.

In addition to the bulk-alloy improvements, some near-surface modification of the metallic alloy is possible, in some alloy systems and for some dispersoids. The result is a non-uniform distribution of dispersoids, in the near-surface region. In one type of further processing 56 that produces such a non-uniform distribution of dispersoids, the consolidated metallic article is exposed to an oxygen-containing environment at a temperature greater than room temperature, and preferably greater than about 500° F. If there is unreacted stable-dispersoid-forming element 78 or 80 present in the material, the oxygen exposure, leading to the types of nonuniform microstructure shown in FIG. 5, may be either during the initial preparation of the metallic article, in a controlled production setting, or during later service exposure at elevated temperature. In any of these cases, the oxygen diffuses inwardly from the surface 72 into the matrix 76. The inwardly diffused oxygen chemically reacts with the stable-dispersoid-forming additive element (s) that are present near the surface 72 either in solid solution 78 or in discrete phases 80. The result is that few if any unreacted stable-dispersoid-forming additive elements in solid solution 78 or in discrete phases 80 remain near the surface 72, and instead are all reacted to form, respectively, additional fine stable dispersoids 82 and coarse stable dispersoids 84. Consequently, there is a higher concentration of fine stable dispersoids 82 in a diffusion-oxidation zone 86 of depth D1 at and just below the surface 72, as compared with the concentration of the fine stable dispersoids 82 at greater depths. D1 is typically in the range of from about 0.001 to about 0.003 inches for titanium alloys, but may be smaller or larger.

In some circumstances the stable dispersoids 82 and 84 have a higher specific volume than the stable-dispersoid-forming additive elements from which they are produced. This higher specific volume creates a compressive force, indicated by arrow 90, in the matrix 76 near the surface 72. The compressive force 90 inhibits crack formation and growth when the article is loaded in tension or torsion during service, a highly beneficial result. Additionally, depending upon the specific dispersoid formed by the stable-dispersoid-forming elements, there may be formed a stable surface layer 88, that may serve as a diffusion barrier to the diffusion of oxygen and other elements from the environment 74 into the article 40. Although this non-uniform dispersoid structure is discussed in terms of the most-preferred case, inward diffusion from the free surface 72 of the dispersion-forming element oxygen, the same principles apply to inward diffusion of other dispersoid-forming elements such as nitrogen, carbon, silicon, sulfur, boron, and other dispersion-forming elements that are combinable with the metallic elements in the matrix to form the dispersoid. The dispersion-forming element is preferably supplied from a gaseous phase that contains the dispersion-forming element in either combined or uncombined form, but it may also be provided in some cases from a solid or liquid contacting the free surface 72.

Figure 5:
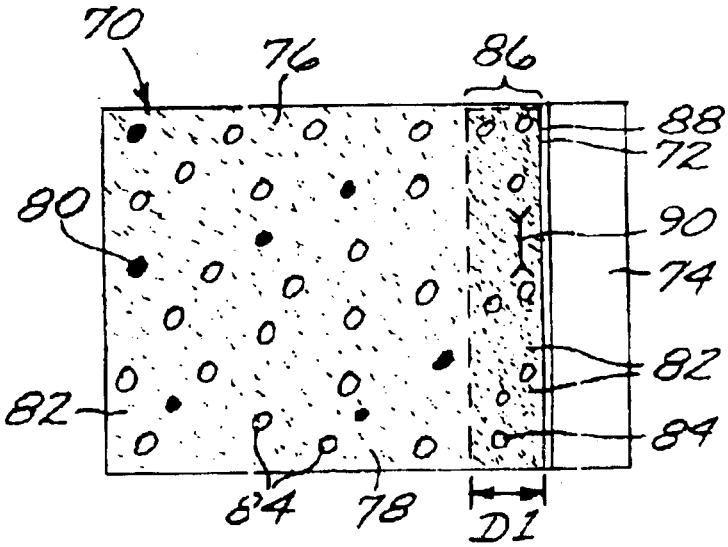
FIG. 5 is an idealized microstructure of the metallic article, after inward diffusion of a reactant during heat treatment or service.
Figure 6:
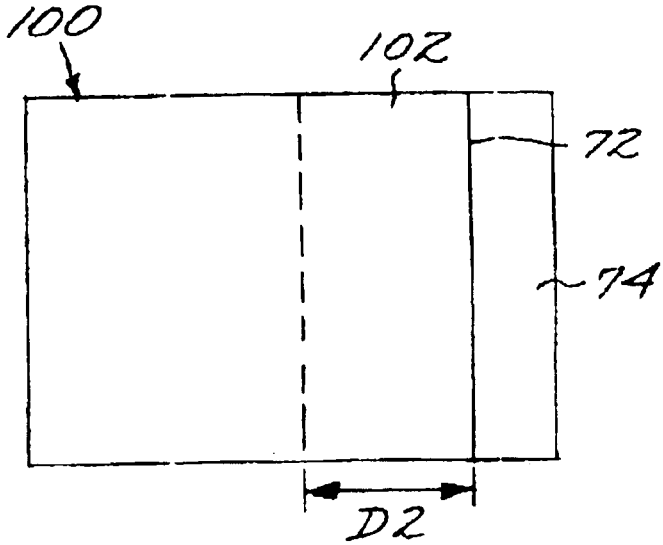
FIG. 6 is an idealized microstructure of a conventional metallic article, after inward diffusion of the reactant.

This structure is to be distinguished from that shown in FIG. 6, a conventional titanium alloy article 100 that is outside the scope of the present approach. In this case, during exposure to an oxygen-containing environment during processing and/or service, oxygen diffuses from the environment 74, through the surface 72, and into the base metal of the article 100 to a depth D2, which is typically from about 0.003 to about 0.005 inch in titanium alloys. In the instance of certain titanium alloys, for example, the excess oxygen reacts with and embrittles the alpha-phase titanum in this region to form an alpha case 102. In the present approach as illustrated in FIG. 5, on the other hand, the gettering of the inwardly diffusing oxygen by the stable-dispersoid-forming additive elements and the stable surface layer 88 combined to reduce and, desirably, avoid the formation of such an oxygen-stabilized alpha case.

The presence and the nature of the distribution of the stable dispersoids 82 and 84, in either a uniform or non-uniform distribution, has several additional important consequences. The stable dispersoids 82 and 84 serve to stiffen the matrix 76 by the composite-stiffening effect, strengthen the matrix 76 by the dispersion-strengthening effect and/or the composite strengthening effect, and also improve the elevated-temperature creep strength of the matrix 76. The stable dispersoids 82 and 84 may also pin grain boundaries of the matrix 76 to inhibit coarsening of the grain structure during processing and/or elevated temperature exposure.

When the dispersoid precursor approach is used and the dispersoid precursor is a preferential oxygen getter, the dispersoids 38, 82, 84 in the metallic matrix 34, 76 also remove oxygen (or other combinable element such as nitrogen, carbon, boron, or sulfur) from the matrix 34, 76, regardless of how the oxygen (or other combinable element) was introduced into the matrix 34, 76. Desirably, substantially all of the oxygen (or other combinable element) is removed from solid solution. Too much oxygen (or other element) in solid solution in the matrix 34, 76 may have adverse effects on the properties of the initial metallic material and/or the consolidated article in some cases. Removal of at least a portion of, and in some cases substantially all of, the oxygen (or other combinable element) may also allow other desirable alloying elements to be introduced into the matrix to a degree greater than possible when a substantial oxygen (or other combinable element) content is present in solid solution.

The present approach may be used to prepare a wide range of dispersion-strengthened alloys, including without limitation nickel-base, iron-base, cobalt-base, and aluminum-base alloys. These dispersion-strengthened alloys include alloys similar in composition to those which can be produced by other techniques such as mechanical alloying (but having the advantages over mechanical alloying discussed herein, and alloys that cannot be prepared in dispersion-strengthened form by other approaches. Some specific examples include nickel-base alloys such as MA754, dispersion-strengthened Rene™108, dispersion-strengthened Rene™125, and dispersion-strengthened Alloy 718; iron-base alloys such as MA956 and dispersion-strengthened A286; titanium-base alloys such as dispersion-strengthened Ti-6242; cobalt-base alloys such as dispersion-strengthened L605; and aluminum-base alloys such as Al-9052, and Al-905XL; and dispersion strengthened 7075. The present approach is not limited to these alloys, which are presented as examples and not by way of limitation.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method of preparing an article comprising a metallic matrix having its constituent elements and a dispersoid distributed therein, comprising the steps of furnishing at least one nonmetallic matrix precursor compound, all of the nonmetallic matrix precursor compounds collectively including the constituent elements of the metallic matrix in their respective constituent-element proportions; thereafter producing a mixture of an initial metallic material and the dispersoid, the step of producing including the step of chemically reducing the matrix precursor compounds to produce the initial metallic material, without melting the initial metallic material, wherein the initial metallic material is selected from the group consisting of a nickel-base material, a cobalt-base material, a titanium-base material, a magnesium-base material, and an aluminum-base material; and consolidating the mixture of the initial metallic material and the dispersoid to produce a consolidated article having the dispersoid distributed in the metallic matrix comprising the initial metallic material, without melting the initial metallic material, without melting the dispersoid, and without melting the consolidated article.

2. The method of claim 1, wherein the step of producing includes the steps of furnishing the dispersoid, and mixing the dispersoid with the matrix precursor compounds prior to or concurrently with the step of chemically reducing.

3. The method of claim 1, wherein the step of producing includes the steps of furnishing the dispersoid, and mixing the dispersoid with the initial metallic material after the step of chemically reducing.

4. The method of claim 1, wherein the step of producing includes the steps of furnishing a dispersoid-precursor, and mixing the dispersoid precursor with the matrix precursor compound prior to or concurrently with the step of chemically reducing, and wherein the dispersoid precursor chemically reacts during the step of chemically reacting to produce the dispersoid.

5. The method of claim 1, wherein the step of producing includes the steps of first chemically reducing the matrix precursor compounds to produce the initial metallic material, without melting the initial metallic material, introducing a precursor compound of the dispersoid into the initial metallic material, second chemically reducing the precursor compound of the dispersoid to produce a first element of the dispersoid, and chemically reacting the first element of the dispersoid with a second element of the dispersoid.

6. The method of claim 1, wherein there is no mechanical deformation of the initial metallic material prior to the step of consolidating.

7. The method of claim 1, wherein the step of furnishing at least one nonmetallic matrix precursor compound includes the step of furnishing a compressed mass of the matrix precursor compounds.

8. The method of claim 1, wherein the step of furnishing at least one nonmetallic matrix precursor compound includes the step of furnishing a compressed mass of nonmetallic matrix precursor compounds larger in dimensions than those of the consolidated article.

9. A method of preparing an article comprising a metallic matrix having its constituent elements and a dispersoid distributed therein, comprising the steps of furnishing at least one nonmetallic matrix precursor compound, all of the nonmetallic matrix precursor compounds collectively including the constituent elements of the metallic matrix in their respective constituent-element proportions; thereafter producing a mixture of an initial metallic material and the dispersoid, the step of producing including the step of chemically reducing the matrix precursor compounds to produce the initial metallic material, without melting the initial metallic material, wherein the step of chemically reducing includes the step of producing a sponge of the initial metallic material; and consolidating the mixture of the initial metallic material and the dispersoid to produce a consolidated article having the dispersoid distributed in the metallic matrix comprising the initial metallic material, without melting the initial metallic material, without melting the dispersoid, and without melting the consolidated article.

10. A method of preparing an article comprising a metallic matrix having its constituent elements and a dispersoid distributed therein, comprising the steps of furnishing at least one nonmetallic matrix precursor compound, all of the nonmetallic matrix precursor compounds collectively including the constituent elements of the metallic matrix in their respective constituent-element proportions; thereafter producing a mixture of an initial metallic material and the dispersoid, the step of producing including the step of chemically reducing the matrix precursor compounds to produce the initial metallic material, without melting the initial metallic material, wherein the step of chemically reducing includes the step of producing particles of the initial metallic material, wherein the initial metallic material is selected from the group consisting of a nickel-base material, a cobalt-base material, a titanium-base material, a magnesium-base material, and an aluminum-base material; and consolidating the mixture of the initial metallic material and the dispersoid to produce a consolidated article having the dispersoid distributed in the metallic matrix comprising the initial metallic material, without melting the initial metallic material, without melting the dispersoid, and without melting the consolidated article.

11. The method of claim 1, wherein the step of chemically reducing includes the step of chemically reducing the mixture of nonmetallic matrix precursor compounds by solid-phase reduction.

12. The method of claim 1, wherein the step of chemically reducing includes the step of chemically reducing the compound mixture by vapor-phase reduction.

13. The method of claim 1, wherein the step of consolidating includes the step of consolidating the initial metallic material using a technique selected from the group consisting of hot isostatic pressing, forging, pressing and sintering, and containerized extrusion.

14. The method of claim 1, including an additional step, after the step of consolidating, of forming the consolidated article.

15. The method of claim 1, including an additional step, after the step of chemically reducing, of heat treating the consolidated article.

16. The method of claim 1, wherein the step of producing the mixture includes the step of producing a dispersoid including an element selected from the group consisting of oxygen, carbon, nitrogen, boron, sulfur, and combinations thereof.

17. The method of claim 1, including an additional step, of exposing, at a temperature greater than room temperature, the consolidated article to an environment containing a dispersion-forming element.

18. The method of claim 9, wherein the step of producing includes the step of producing the initial metallic material selected from the group consisting of a nickel-base material, an iron-base material, a cobalt-base material, a titanium-base material, a magnesium-base material, and an aluminum-base material.

19. A method of preparing an article comprising a metallic matrix having its constituent elements and a dispersoid distributed therein, comprising the steps of furnishing at least one nonmetallic matrix precursor compound, all of the nonmetallic matrix precursor compounds collectively including the constituent elements of the metallic matrix in their respective constituent-element proportions; thereafter producing a mixture of an initial metallic material and the dispersoid, the step of producing including the step of chemically reducing the matrix precursor compounds to produce the initial metallic material, without melting the initial metallic material wherein the step of producing includes the steps of furnishing the dispersoid, and mixing the dispersoid with the initial metallic material after the step of chemically reducing; and consolidating the mixture of the initial metallic material and the dispersoid to produce a consolidated article having the dispersoid distributed in the metallic matrix comprising the initial metallic material, without melting the initial metallic material, without melting the dispersoid, and without melting the consolidated article.

20. A method of preparing an article comprising a metallic matrix having its constituent elements and a dispersoid distributed therein, comprising the steps of furnishing at least one nonmetallic matrix precursor compound, all of the nonmetallic matrix precursor compounds collectively including the constituent elements of the metallic matrix in their respective constituent-element proportions; thereafter producing a mixture of an initial metallic material and the dispersoid, the step of producing including the step of chemically reducing the matrix precursor compounds to produce the initial metallic material, without melting the initial metallic material, wherein the step of producing includes the steps of first chemically reducing the matrix precursor compounds to produce the initial metallic material, without melting the initial metallic material, introducing a precursor compound of the dispersoid into the initial metallic material, second chemically reducing the precursor compound of the dispersoid to produce a first element of the dispersoid, and chemically reacting the first element of the dispersoid with a second element of the dispersoid; and consolidating the mixture of the initial metallic material and the dispersoid to produce a consolidated article having the dispersoid distributed in the metallic matrix comprising the initial metallic material, without melting the initial metallic material, without melting the dispersoid, and without melting the consolidated article.

21. A method of preparing an article comprising a metallic matrix having its constituent elements and a dispersoid distributed therein, comprising the steps of furnishing a compressed mass of at least one nonmetallic matrix precursor compound, all of the nonmetallic matrix precursor compounds collectively including the constituent elements of the metallic matrix in their respective constituent-element proportions; thereafter producing a mixture of an initial metallic material and the dispersoid, the step of producing including the step of chemically reducing the matrix precursor compounds to produce the initial metallic material, without melting the initial metallic material; and consolidating the mixture of the initial metallic material and the dispersoid to produce a consolidated article having the dispersoid distributed in the metallic matrix comprising the initial metallic material, without melting the initial metallic material, without melting the dispersoid, and without melting the consolidated article.

22. A method of preparing an article comprising a metallic matrix having its constituent elements and a dispersoid distributed therein, comprising the steps of furnishing a compressed mass at least one nonmetallic matrix precursor compound larger in dimensions than those of a consolidated article, all of the nonmetallic matrix precursor compounds collectively including the constituent elements of the metallic matrix in their respective constituent-element proportions; thereafter producing a mixture of an initial metallic material and the dispersoid, the step of producing including the step of chemically reducing the matrix precursor compounds to produce the initial metallic material, without melting the initial metallic material; and consolidating the mixture of the initial metallic material and the dispersoid to produce the consolidated article having the dispersoid distributed in the metallic matrix comprising the initial metallic material, without melting the initial metallic material, without melting the dispersoid, and without melting the consolidated article.

23. A method of preparing an article comprising a metallic matrix having its constituent elements and a dispersoid distributed therein, comprising the steps of furnishing at least one nonmetallic matrix precursor compound, all of the nonmetallic matrix precursor compounds collectively including the constituent elements of the metallic matrix in their respective constituent-element proportions; thereafter producing a mixture of an initial metallic material and the dispersoid, the step of producing including the step of chemically reducing the matrix precursor compounds by vapor-phase reduction to produce the initial metallic material; and consolidating the mixture of the initial metallic material and the dispersoid to produce a consolidated article having the dispersoid distributed in the metallic matrix comprising the initial metallic material, without melting the initial metallic material, without melting the dispersoid, and without melting the consolidated article.

24. A method of preparing an article comprising a metallic matrix having its constituent elements and a dispersoid distributed therein, comprising the steps of furnishing at least one nonmetallic matrix precursor compound, all of the nonmetallic matrix precursor compounds collectively including the constituent elements of the metallic matrix in their respective constituent-element proportions; thereafter producing a mixture of an initial metallic material and the dispersoid, the step of producing including the step of chemically reducing the matrix precursor compounds to produce the initial metallic material, without melting the initial metallic material;

consolidating the mixture of the initial metallic material and the dispersoid to produce a consolidated article having the dispersoid distributed in the metallic matrix comprising the initial metallic material, without melting the initial metallic material, without melting the dispersoid, and without melting the consolidated article; and exposing, at a temperature greater than room temperature, the consolidated article to an environment containing a dispersion-forming element.

25. The method of claim 1, wherein the step of producing includes the step of producing a nickel-base material as the initial metallic material.

26. The method of claim 1, wherein the step of producing includes the step of producing a cobalt-base material as the initial metallic material.

27. The method of claim 1, wherein the step of producing includes the step of producing a titanium-base material as the initial metallic material.

28. The method of claim 1, wherein the step of producing includes the step of producing a magnesium-base material as the initial metallic material.

29. The method of claim 1, wherein the step of producing includes the step of producing an aluminum-base material as the initial metallic material.

* * * * *